US005134895A

United States Patent [19]

Harmon et al.

[11] Patent Number: 5,134,895

[45] Date of Patent: Aug. 4, 1992

[54] CONTROLLER FOR A VEHICLE

[75] Inventors: Kevin E. Harmon, Erie; John B. Bendig, Waterford, both of Pa.

[73] Assignee: General Electric Company, Erie, Pa.

[21] Appl. No.: 629,775

[22] Filed: Dec. 18, 1990

[51] Int. Cl.[5] ..... G05G 11/00

[52] U.S. Cl. ..... 74/483 R; 74/491; 74/479; 192/1.53

[58] Field of Search ..... 74/483 R, 491, 470, 74/479; 192/1.52-1.55, 1.56

[56] References Cited

U.S. PATENT DOCUMENTS

| | | | |
|---|---|---|---|
| 166,026 | 7/1875 | Moschcowitz | 180/78 |
| 564,632 | 7/1896 | Mitchell | 192/1.52 |
| 576,384 | 2/1897 | Thomas et al. | 192/1.52 |
| 634,832 | 10/1899 | Pearson | 192/1.53 |
| 872,732 | 12/1907 | Johnson | 192/1.53 |
| 1,161,006 | 10/1915 | Muzzy | 192/1.53 |
| 2,025,262 | 12/1935 | Anderson | 60/16 |
| 2,202,551 | 5/1940 | Guffy | 192/1 |
| 2,249,955 | 7/1941 | Hewitt | 192/2 |
| 2,290,962 | 7/1942 | Hewitt | 192/1.55 |
| 2,647,415 | 8/1953 | Dean et al. | 74/483 R |
| 2,667,247 | 1/1954 | May | 192/3 |
| 3,842,653 | 10/1974 | Blonn, Sr. | 74/483 R |
| 4,111,062 | 9/1978 | Callaghan | 74/470 |
| 4,195,534 | 4/1980 | Prince | 74/491 |
| 4,796,480 | 1/1989 | Amos et al. | 74/483 |

*Primary Examiner*—Leslie A. Braun
*Assistant Examiner*—Winnie Yip

[57] ABSTRACT

A controller for a railway locomotive is provided having a first control handle which controls propulsion power and braking power, and a second control handle which controls the direction of movement of the locomotive. The controller includes first and second shafts having a plurality of cams fixed thereto for actuating propulsion and braking power control contacts. Additional cams are rotatably mounted on the second shaft for actuating contacts which control the direction in which the locomotive travels. The first control handle is connected to a drive gear which is operatively connected by two lost motion mechanisms to the first and second control shafts. By manually operating the first control handle, the drive gear and two lost motion mechanisms selectively and alternatively rotate the first and second shafts so as to control propulsion power and braking power for the locomotive. The second handle may be manually actuated to rotate the additional control cams about the second shaft in order to control the direction of movement of the locomotive.

11 Claims, 5 Drawing Sheets

CONTROLLER FOR A VEHICLE

BACKGROUND OF THE INVENTION

This invention relates generally to a controller for railway locomotives and, more particularly, to an improved controller including a single drive handle which is capable of controlling propulsion power and braking power for locomotives.

It is known in the art to employ manually actuated electro-mechanical controllers to control many of the operating functions of diesel locomotives and the like. For example, it is known to employ a controller comprising three manually actuated control handles, each operatively connected to one of three sets of control cams. The first set of control cams are mounted on a first control shaft and serve to actuate propulsion power control contacts. The second and third sets of control cams are located on a second control shaft and serve to actuate braking power and reverser control contacts, respectively. This known controller, however, has been found to be undesirable because it includes three control handles instead of a preferred number of two.

It is also known in the art to employ manually actuated electro-mechanical controllers having only two control handles to control many of the operating functions of diesel locomotives and the like. For example U.S. Pat. No. 4,796,490 discloses a controller which utilizes only a throttle/dynamic brake handle and a reverser handle. This two handle controller, however, does not employ a first control shaft for mounting propulsion power control cams, and a second control shaft for mounting braking power and reverser control cams. As a result, the design of this two handle controller is substantially different from the existing three handle controller, discussed above, and does not disclose a mechanism which could be used easily to convert the existing three handle controller to one having two handles.

As a result, there is a need for a new design which adapts the existing three control handle controller, discussed above, to one having only two control handles.

SUMMARY OF THE INVENTION

The present invention meets that need by providing a design which adapts an existing three handle controller into one having only two control handles. The resulting two handle controller comprises a first control handle which serves to control both locomotive propulsion power and braking power, and a second control handle which serves to control the direction of travel of the locomotive. The two handle controller further comprises first and second shafts having a plurality of cams fixed thereto for actuating propulsion and braking control contacts. Additional cams are rotatably mounted onto the second shaft for actuating contacts which control the direction of travel of the locomotive. The first control handle is connected to a drive gear which is operatively connected by two lost motion mechanisms to the first and second shafts. By manually operating the first control handle, the drive gear and lost motion mechanisms selectively and alternatively rotate the first and second shafts so as to control locomotive propulsion power and braking power. The second handle may be manually actuated to rotate the direction control cams about the second shaft in order to control the travel direction of the locomotive.

In accordance with a first aspect of the present invention, a propulsion and brake control device for a vehicle is provided and comprises: first shaft controller means rotatable about a first axis for controlling propulsion power for the vehicle; second shaft controller means rotatable about a second axis for controlling braking power for the vehicle; and, actuating means for selectively and alternatively rotating one of the first and second shaft controller means, thereby controlling the propulsion power and the braking power of the vehicle.

The actuating means includes drive means, such as, for example, a drive gear, being movable in a first direction for initiating rotational motion of the first shaft controller means and being movable in a second direction for initiating rotational motion of the second shaft controller means. The actuating means further includes first lost motion means operatively positioned on the first shaft controller means and second lost motion means operatively positioned on the second shaft controller means. Both the first and second lost motion means are operatively engageable with the drive means. Upon the drive means being moved in the first direction, the first lost motion means serves to transmit initiating rotational motion from the drive means to the first shaft means. Upon the drive means being moved in the second direction, the second lost motion means serves to transmit initiating rotational motion from the drive means to the second shaft means.

The first lost motion means preferably comprises a first freewheeling gear which is rotatably mounted on the first shaft controller means and engages with the drive means to rotate therewith. The first freewheeling gear preferably includes a first arcuate engagement slot located therein. The first lost motion means further comprises a first transition gear which is fixed on the first shaft controller means and has a first outer portion which is non-engageable with the drive means and a second outer portion which is engageable with the drive means. The first transition gear further comprises a first engagement pin which extends into the slot of the first freewheeling gear and is movable by the slot when the drive means rotates in the first direction. The first transition gear is rotated by the movement of the pin by the slot of the first freewheeling gear so as to permit the second outer portion of the first transition gear to engage the drive gear.

The second lost motion means preferably comprises a second freewheeling gear which is rotatably mounted on the second shaft controller means and engages with the drive means to rotate therewith. The second freewheeling gear preferable comprises a second arcuate engagement slot located therein. The second lost motion means further comprises a second transition gear which is fixed on the second shaft controller means and has a first outer portion which is non-engageable with the drive means and a second outer portion which is engageable with the drive means. The second transition gear further comprises a second engagement pin which extends into the second slot and is movable by the second slot when the drive means rotates in the second direction. The second transition gear is rotated by the movement of the second pin by the second slot so as to permit the second outer portion of the second transition gear to engage the drive gear.

The first shaft controller means preferably comprises a first shaft having a square portion and a cylindrical portion. The first freewheeling gear is mounted for free rotation on the cylindrical portion and the first transition gear is fixedly mounted on the square portion. The second shaft controller means preferably comprises a second shaft having a square portion and a cylindrical portion. The second freewheeling gear is operatively connected to the cylindrical portion of the second shaft for free rotation and the second transition gear is operatively mounted on the square portion of the second shaft.

The first shaft controller means preferably further includes a plurality of throttle cams which are operatively mounted upon the first shaft. The throttle cams serve to actuate speed control contacts upon rotation of the first shaft to control the propulsion power of the vehicle. The second shaft controller means further comprises a plurality of braking cams which are operatively mounted on the second shaft. The braking cams serve to actuate brake control contacts upon rotation of the second shaft to control the braking power of the vehicle. The second shaft is additionally connected to a brake control potentiometer, which is operated by rotation of the second shaft to additionally control the braking power of the vehicle.

In accordance with a second aspect of the present invention, a propulsion and brake control device for a locomotive is provided and comprises: first shaft controller means being rotatable about a first axis for controlling propulsion power for the locomotive; second shaft controller means being rotatable about a second axis for controlling braking power for the locomotive; and, actuating means including a single drive handle for selectively and alternatively rotating one of the first and second shaft controller means, thereby controlling the propulsion power and the braking power for the locomotive.

The actuating means preferably comprises drive means, first lost motion means, and second lost motion means as discussed above with respect to the first aspect of the present invention.

The first shaft controller means preferably includes a first shaft having a square portion and a cylindrical portion. The first freewheeling gear is mounted on the cylindrical portion and the first transition gear is mounted on the square portion. The second shaft controller means preferably includes a second shaft having a square portion and a cylindrical portion. The second freewheeling gear is mounted on the cylindrical portion of the second shaft and the second transition gear is mounted on the square portion of the second shaft.

The first shaft controller means preferably further includes a plurality of throttle cams which are fixedly mounted upon the first shaft. The throttle cams serve to actuate speed control contacts upon rotation of the first shaft to control the propulsion power of the locomotive. The second shaft controller means further includes a plurality of braking cams which are fixedly mounted on the second shaft. The braking cams serve to actuate brake control contacts upon rotation of the second shaft to control the braking power of the locomotive. The second shaft is additionally connected to a brake control potentiometer, which is operated by rotation of the second shaft to additionally control the braking power of the locomotive.

Accordingly, it is an object of the present invention to provide a controller for controlling a locomotive with two control handles, one of which serves to actuate propulsion power and braking power, and the other of which serves to control the direction of movement of the locomotive. It is a further object of the present invention to adapt a prior art three handle controller having separate braking and power control shafts to a controller which includes only two control handles. This and other objects and advantages of the invention will be apparent from the following description, the accompanying drawings and the appended claims.

BRIEF DESCRIPTION OF THE DRAWINGS

FIGS. 1 and 2 illustrate the controller of the present invention mounted in an operating console of a locomotive or the like;

DETAILED DESCRIPTION OF THE PREFERRED EMBODIMENT

Figure 1:
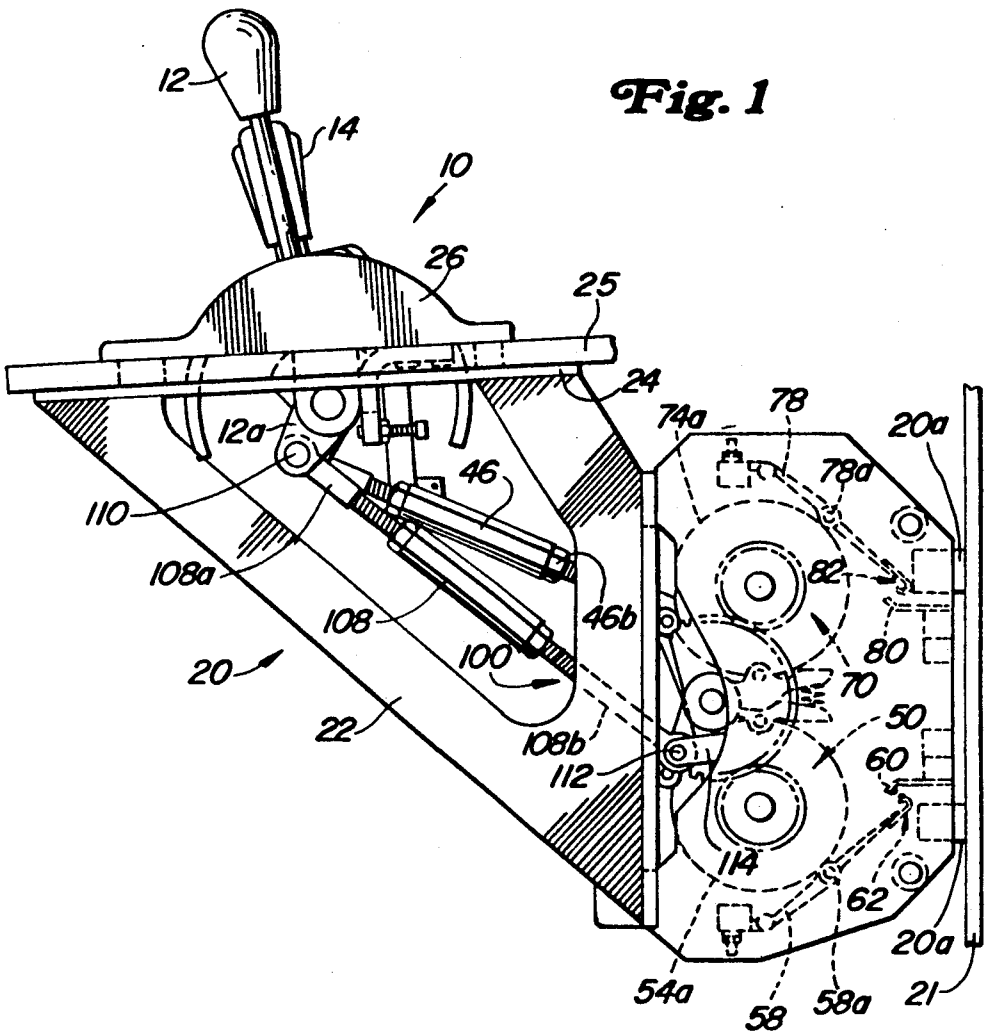
Figure 2:
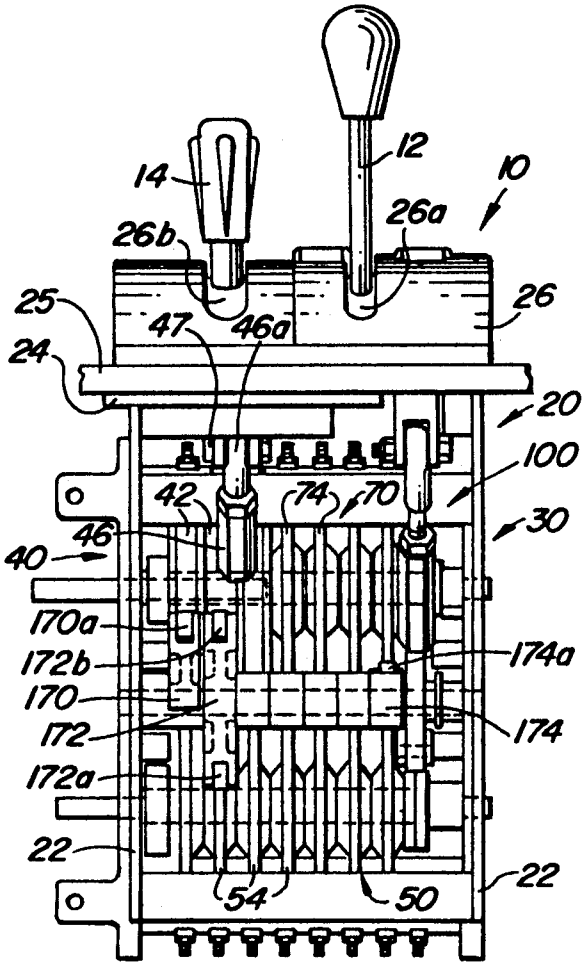

The controller of the present invention, generally designated by reference numeral 10, is shown in FIGS. 1 and 2 mounted in a casing 20 comprising side plates 22 and an upper plate 24. The casing 20 is fixed by brackets 20*a* or the like to a portion of a cab frame 21 in a locomotive. Attached to the upper plate 24 is a portion of a console 25 and a top cover 26, including guide slots 26*a* and 26*b* located therein. Extending through the upper plate 24, the console 25 and the two guide slots 26*a* and 26*b* are two manually actuated control handles 12 and 14. The first control handle 12, also referred to herein as a drive control handle, forms part of a propulsion and brake control device 30, which serves to control propulsion power and braking power for the locomotive. The second control handle 14, also referred to herein as a reverser control handle, forms part of a reverser control device 40, which serves to control the direction (forward or reverse) in which the locomotive is driven.

Figure 3:
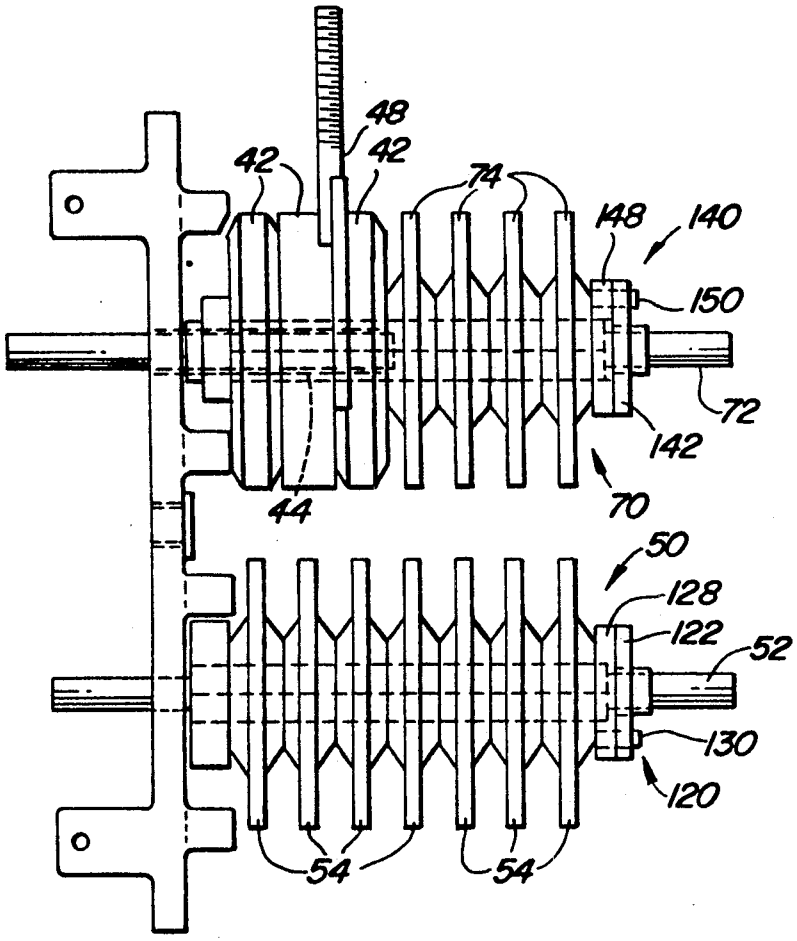
FIG. 3 is a side elevational view of the first and second shaft controller means, and the first and second lost motion means of the controller shown in FIGS. 1 and 2.

Referring to FIGS. 1–3, the propulsion and brake control device 30 includes first and second shaft controller means 50 and 70, respectively, for controlling propulsion power and braking power for the locomotive. Actuating means 100, including the first control handle 12, are also provided for selectively and alternatively rotating one of the first and second shaft controller means 50 and 70, thereby permitting an operator to selectively control via the single control handle 12 propulsion power and braking power for the locomotive.

Figure 5:
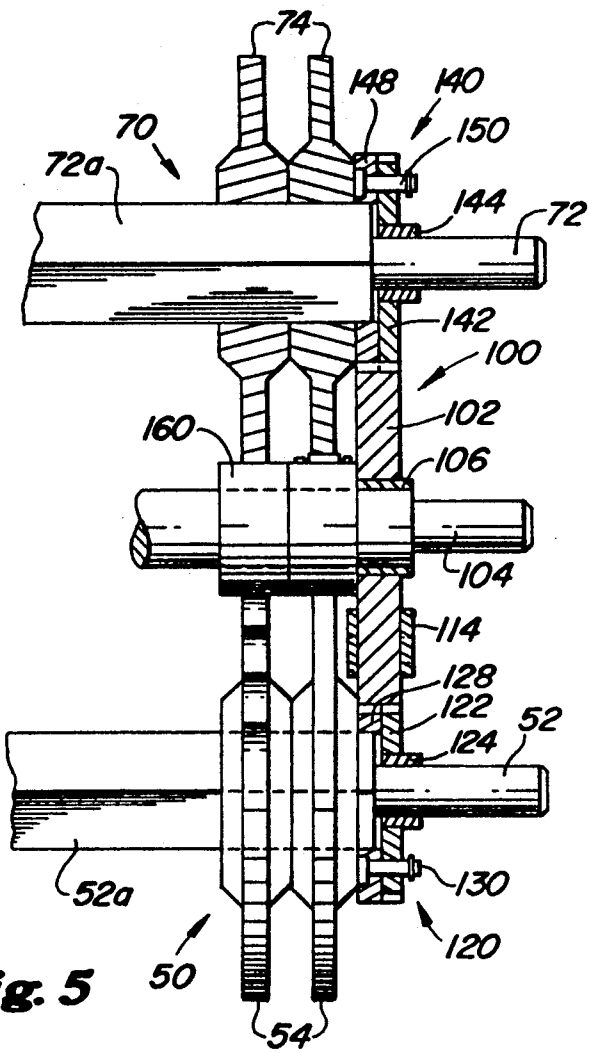
FIG. 5 is a partial cross-sectional view along lines 5—5 in FIG. 4.

The first shaft controller means 50, as best shown in FIGS. 3 and 5, comprises a first shaft 52 having a plurality of propulsion control cams 54 mounted thereon. Each propulsion control cam 54 is fixedly mounted on a square portion 52*a* of the first shaft 52, so as to be rotated therewith. The cams 54 have central openings of square shape corresponding to the cross-section of the square portion 52*a* of the shaft 52.

Each propulsion control cam 54 is adapted to operate a corresponding spring-biased contact finger 58, as shown in FIG. 1, into and out of contact with a fixed contact member 60. Each contact finger 58 is provided with a roller 58*a*, which engages a peripheral edge 54*a* on its respective cam 54. The peripheral edge 54*a* of each cam 54 includes a notch or recess 54*b* therein, shown in FIGS. 4 and 8, which, when entered into by the roller 58*a*, allows the contact finger 58 to engage with the fixed contact member 60. When the roller 58*a* engages an unnotched portion 54*c* of the peripheral edge 54*a* of the cam 54, the finger 58 is shifted out of contact with the fixed contact member 60.

Fingers 58 and fixed contact members 60 comprise a plurality of switches 62 which, when closed, send electrical signals to a control processor (not shown). The processor, upon receiving these signals, acts to control the propulsion power for the locomotive. The specific contour of the outer peripheral edges 54*a* of the cams 54 and the relative angular position of one to the other is such that the contact fingers 58 are operated into and out of bridging contact with the fixed contact members 60 in connection with manipulation of the first control handle 12 so as to provide the desired propulsion power in a desired manner in either a forward or reverse direction of motion of the locomotive.

The second shaft controller means 70 comprises a second shaft 72 having a plurality of brake control cams 74 mounted thereon, as shown best in FIGS. 3 and 5. Each of the brake control cams 74 is fixedly mounted on a square portion 72*a* of the second shaft 72, so as to be rotated therewith. The cams 74 have central openings of square shape corresponding to the cross-section of the square portion 72*a* of the shaft 72.

The second shaft 72 is further operatively engaged with a brake control potentiometer (not shown), which is controlled by movement of the shaft 72. As discussed below, when the shaft 72 is rotated, the potentiometer generates corresponding signals for the control processor, which employs the signals to control the braking power for the locomotive.

As shown in FIG. 1, each cam 74 is adapted to operate a corresponding contact finger 78 into and out of contact with a fixed contact member 80. Each contact finger 78 is provided with a roller 78*a* which engages the peripheral edge 74*a* of its respective cam 74. The peripheral edge 74*a* of each cam 74 includes a notch or recess 74*b* therein, shown in FIGS. 4 and 8, which, when entered into by the roller 78*a*, allows the contact finger 78 to engage with the fixed contact member 80. When the roller 78*a* engages an unnotched portion 74*c* of the peripheral edge 74*a* of the cam 74, the finger 78 is shifted out of contact with the fixed contact member 80.

Fingers 78 and fixed contact members 80 comprise a plurality of switches 82 which, when closed, send electrical signals to the control processor. The processor, upon receiving these signals and the signals from the potentiometer, acts to control the braking power for the locomotive.

The actuating means 100, which serves to selectively and alternatively rotate one of the first and second shafts 52 and 72, includes a drive gear 102, also referred to herein as drive means, which is rotatably mounted on a third shaft 104 by a bushing 106 or the like. The drive gear 102 is movable in a counter-clockwise direction, as viewed in FIG. 4, for initiating rotational motion of the first shaft 52. The drive gear 102 is also movable in a clockwise direction, as view in FIG. 4, for initiating rotational motion of the second shaft 72. The drive gear 102 is operatively engaged with the first control handle 12 via a drive linkage 108, shown in FIGS. 1 and 2. The first end 108*a* of the linkage 108 is connected by a pin 110 to a yoke 12*a*, which is fixed to the first control handle 12. The second end 108*b* of the linkage 108 is connected by a pin 112 to two lugs 114, which are fixed, such as by bolts (not shown), to the drive gear 102.

The drive control handle 12 may be moved clockwise, as viewed in FIG. 1, to apply braking power to the locomotive. In order to apply braking power, the drive control handle 12 is preferably movable from a centrally located idle position, where no braking power is being applied, to a set-up position, and into a brake control zone, where braking power is applied to the locomotive. The amount of braking power applied to the locomotive can be controlled and varied depending upon the position of the control handle 12 in the brake control zone. The handle 12 may also be moved in a counterclockwise direction, as viewed in FIG. 1, to control propulsion power for the locomotive. Preferably, the handle 12 is moved from the idle position to a plurality of discrete drive positions, which increase the amount of propulsion power for the locomotive as the handle moves away from the idle position.

The actuating means 100 further includes first lost motion means 120, shown best in FIGS. 3 and 5, which is mounted onto the first shaft 52 and is operatively engaged with the drive gear 102 so as to transmit the initiating rotational motion from the drive gear 102 to the first shaft 52 upon the drive gear 102 being rotated in the counterclockwise direction. The first lost motion means 120 includes a first freewheeling gear 122 which includes an arcuate engagement slot 126 therein. The first freewheeling gear 122 is rotatably mounted on the first shaft 52 by a bushing 124 or the like, and engages with the drive gear 102 at all times so as to rotate therewith.

Figure 7:
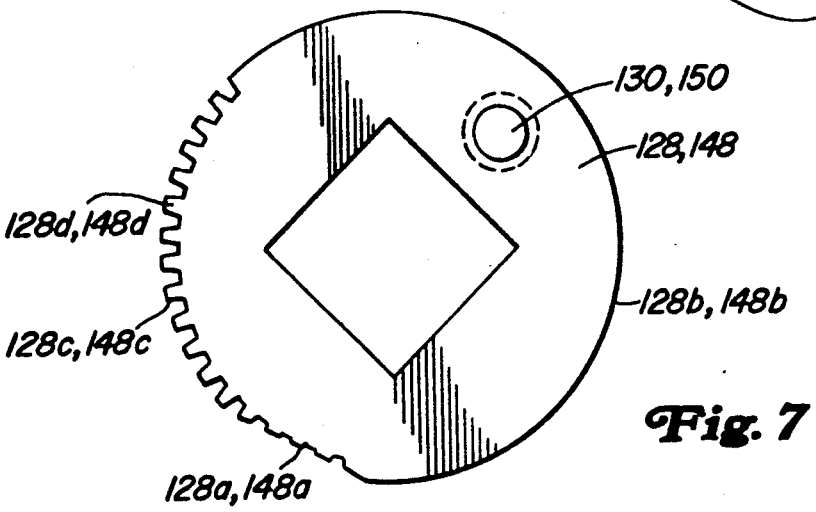
FIG. 7 is an enlarged side view of a transition gear of the present invention.

The first lost motion means 120 further includes a first transition gear 128, best shown in FIG. 7, which is fixedly mounted onto the square portion 52*a* of the first shaft 52 so as to rotate therewith. The first transition gear 128 includes a first engagement pin 130 which extends into the slot 126 of gear 122 and is movable by an end portion of the slot 126 when the drive gear 102 is rotated in the counterclockwise direction. The first transition gear 128 further includes a transition contour or first outer portion 128*a* on its outer periphery 128*b*, which is notched or cut-away so as not to be engageable with the drive gear 102 when positioned directly adjacent to the outer periphery 102*a* of the drive gear 102. Also located on the outer periphery 128*b* of the transition gear 128 is a second portion 128*c* comprising gear teeth 128*d*. The second portion 128*c* of the gear 128 is engageable with the drive gear 102 when it is positioned directly adjacent to the outer periphery 102*a* of the drive gear 102.

The actuating means 100 further includes second lost motion means 140 which is mounted on the second shaft 72 and is operatively engaged with the drive gear 102 to transmit the initiating rotational motion from the drive gear 102 to the second shaft 72 upon the drive gear 102 being rotated in the clockwise direction. The second lost motion means 140 includes a second freewheeling gear 142 which includes an arcuate engagement slot 146 therein. The second freewheeling gear 142 is rotatably mounted on the second shaft 72 by a bushing 144 or the like, and engages with the drive gear 102 at all times so as to rotate therewith.

The second lost motion means 140 further includes a second transition gear 148, which is fixedly mounted on the square portion 72*a* of shaft 72 so as to rotate therewith. The second transition gear 148 includes a second engagement pin 150 which extends into the slot 146 of the gear 142 and is movable by an end portion of the slot 146 when the drive gear 102 is rotated in the clockwise direction. The second transition gear 148 includes a transition contour or first outer portion 148*a* on its outer periphery 148*b* which is notched or cut-away so as not to be engageable with the drive gear 102 when positioned directly adjacent to the outer periphery 102*a* of the drive gear 102. Also included on the outer periphery 148*b* of the second transition gear 148 is a second outer portion 148*c* comprising gear teeth 148*d*. The second portion 148*c* is engageable with the drive gear 102 when it is located directly adjacent to the outer periphery 102*a* of the drive gear 102.

Figure 8:
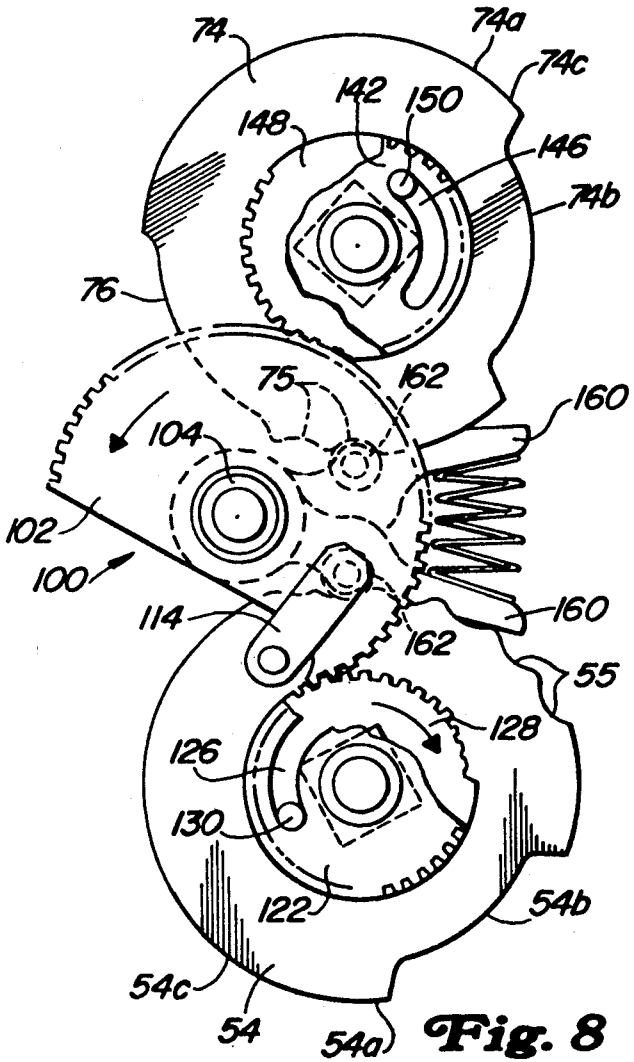
FIG. 8 is an end view of the first and second shaft controller means, the first and second lost motion means, and the drive gear, with the drive gear being rotated in a counterclockwise direction, see the second drawing sheet.
Figure 4:
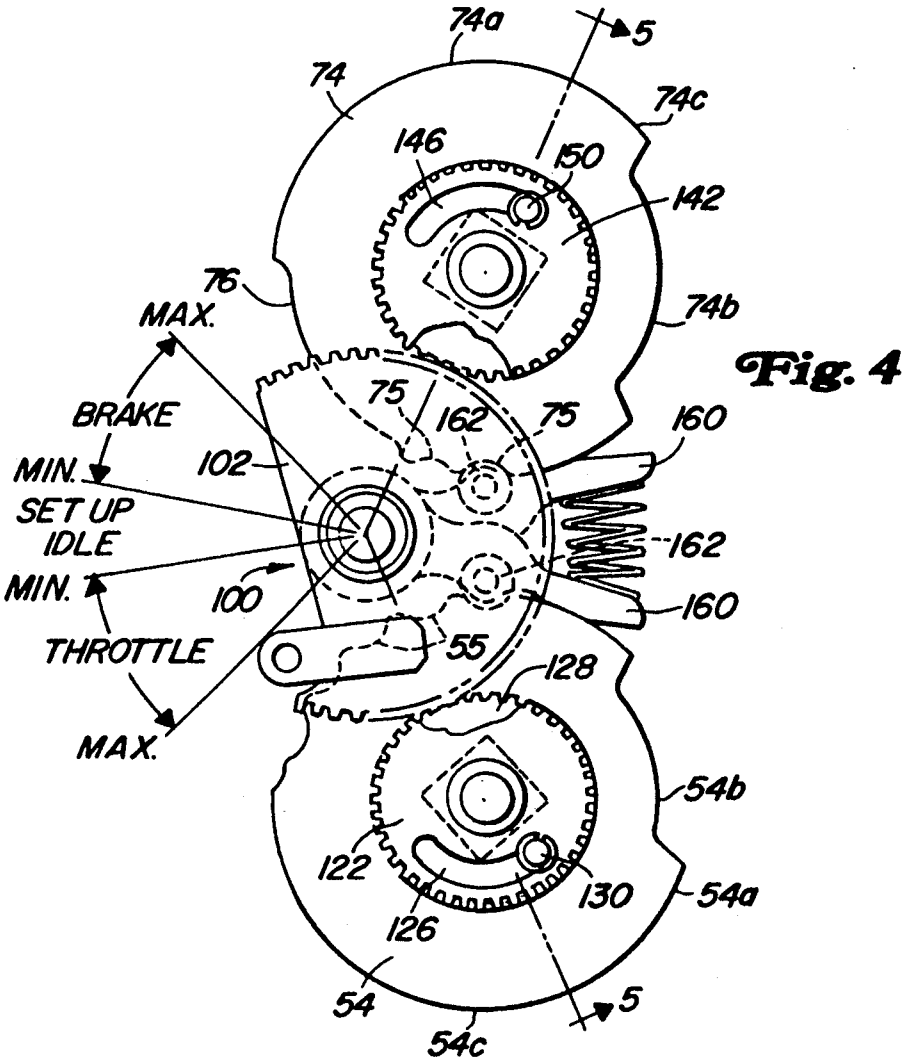
FIG. 4 is an end view of the first and second shaft controller means, the first and second lost motion means, and the drive gear of the controller of the present invention.

Feel of movement of the first control handle 12 is provided by a detent mechanism comprising a plurality of spring biased pawls 160, best shown in FIGS. 4 and 8. Each of the spring biased pawls 160 is rotatably mounted on the third shaft 104. Each pawl 160 is associated with either a propulsion control cam 54 or a brake control cam 74 and includes a roller 162 thereon which serves to engage one or more notches or recesses located in the outer periphery of its corresponding cam.

Each propulsion control cam 54 preferably includes one or more notches 55 thereon corresponding to an idle position and one or more drive positions of the control handle 12. A propulsion control cam 54 is shown in FIGS. 4 and 8 which includes a notch 55 for idle and each drive position of the control handle 12. It is noted that not every cam 54 must include a notch 55 for idle and each drive position of the handle 12. However, the cams 54 collectively must include at least one notch 55 corresponding to idle and each drive position of the handle 12.

Each brake control cam 74 likewise may include one or two notches 75 and/or a recess 76 thereon corresponding to the idle position, the set-up position, and the brake control zone of the handle 12. It is noted that not every brake control cam 74 must include a notch 75 thereon for the idle position and the set-up position, and a recess 76 for the brake control zone. However, the cams 74 collectively must include at least one notch 75 corresponding to the idle position and the set-up position, and a recess 76 corresponding to the brake control zone, of the handle 12.

Figure 4A:
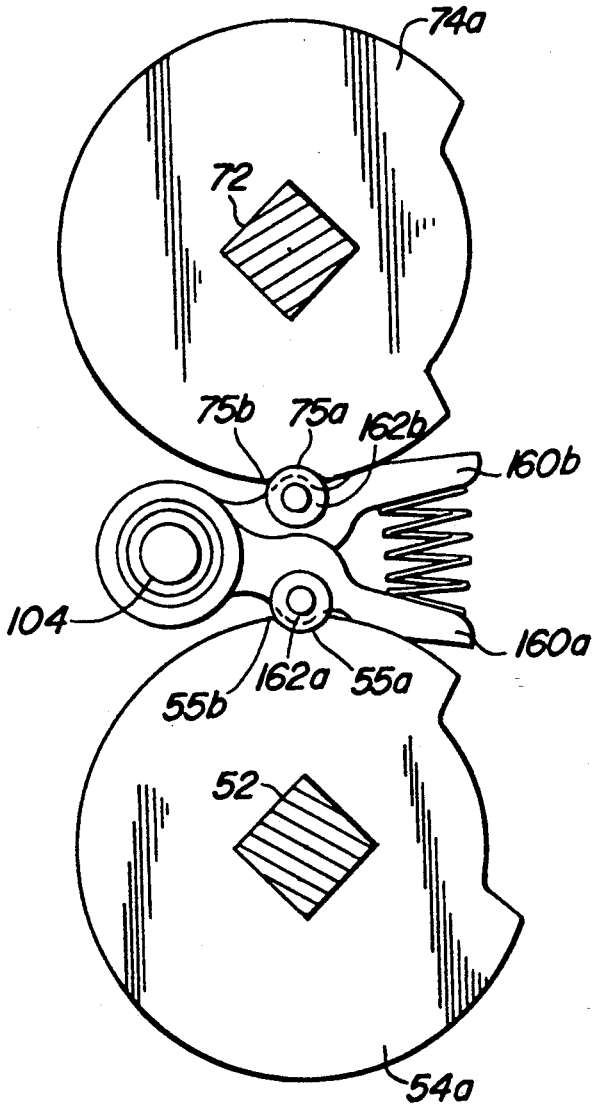
FIG. 4*a* is an end view of a braking control cam and a propulsion control cam, each having a transition notch located thereon.
Figure 6:
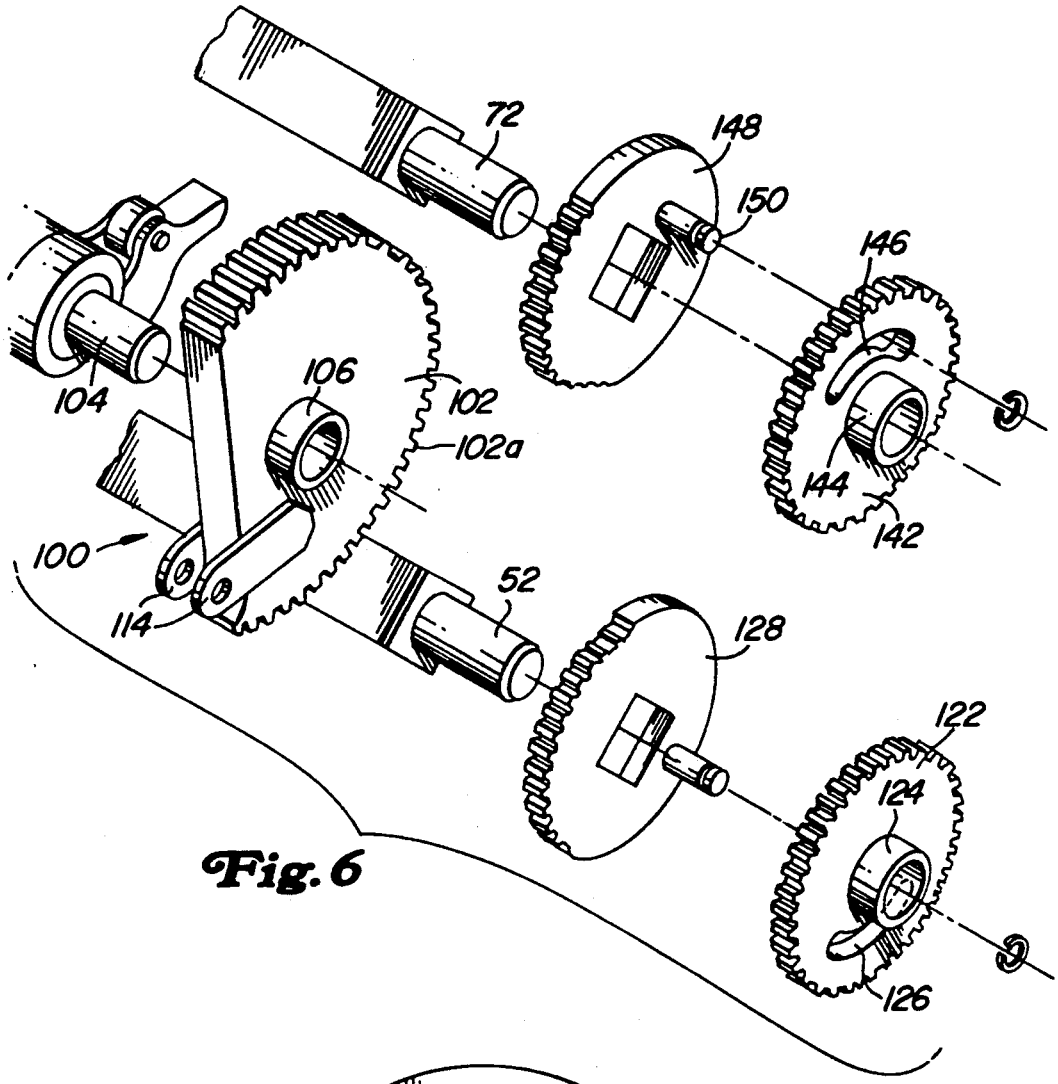
FIG. 6 is an exploded perspective view of the first and second lost motion means and the drive gear.

A transition notch 55*a* is further provided on at least one of the propulsion control cams 54*a*, as shown in FIG. 4*a*. The pawl 160*a* associated with the propulsion control cam 54*a* acts with the transition notch 55*a* to rotate the first shaft 52 a few degrees after the drive gear 102 is disengaged with the teeth 128*d* on the transition gear 128. Just as the drive gear 102 disengages with the teeth 128*d* on the transition gear 128, roller 162*a* on pawl 160*a* just passes over peak 55*b* on the transition notch 55*a*. Thereafter, the spring-biased pawl 160*a*, via its roller 162*a*, acts to push against the propulsion control cam 54*a* until the roller 162*a* is seated within the transition notch 55*a* causing the shaft 52 to rotate a few degrees, thereby ensuring that the drive gear 102 completely disengages with the transition gear 128.

Likewise, a transition notch 75*a* is provided on one of the brake control cams 74*a*. The pawl 160*b* associated with the brake control cam 74*a* acts with the transition notch 75*a* to rotate the second shaft 72 a few degrees when the drive gear 102 is disengaged with the teeth 148*d* on the transition gear 148. Just as the drive gear 102 disengages with the teeth 148*d* on the transition gear 148, roller 162*b* on pawl 160*b* just passes over peak 75*b* on the transition gear notch 75*a*. Thereafter, the spring-biased pawl 160*b*, via its roller 162*b*, acts to push against the brake control cam 74*a* until the roller 162*a* is seated within the transition notch 75*a* causing the shaft 52 to rotate a few degrees, thereby ensuring that the drive gear 102 disengages completely with the transition gear 148.

Referring to FIGS. 1 and 3, the reverser control device 40 comprises a plurality of reverser cams 42, which are rotatably mounted on the second shaft 72 by bushings 44 or the like. The reverser cams 42 are operatively connected to the second control handle 14 by a reverse linkage 46, shown in FIGS. 1 and 2. The first end 46*a* of the reverse linkage is joined to the control handle 14 by a pin 47. The second end 46*b* of the reverse linkage 46 is joined to a threaded arm 48, shown in FIG. 3, which is pinned to each of the cams 42 by a pin (not shown) extending through two of the cams 42.

The second control handle 14 is capable of being moved from a neutral position to either a forward or reverse position so as to permit an operator to control the direction in which the locomotive travels. As the control handle 14 is moved from position to position, the cams 42 are rotated about the second shaft 72 and, upon being rotated, actuate switches (not shown) which send corresponding signals to the control processor. The processor, upon receiving these signals, acts to control the direction in which the locomotive travels.

As shown in FIG. 2, the controller 10 further includes first, second and third interlock pawls 170, 172, and 174, respectively, which serve to allow the drive control arm 12 to be moved only when the reverser control arm 14 is not in its neutral position, and to allow the reverser control arm 14 to be moved only when the drive control arm 12 is in its idle position. Interlock pawls 170 and 174 are pinned to the third shaft 104 and interlock pawl 172 is rotatably mounted to the shaft 104. The first and third interlock pawls 170 and 174 include rollers 170*a* and 174*a*, respectively, located thereon. When the reverser control handle 14 is located in either its forward or reverse position, roller 170*a* falls into one of two notches (not shown) located on the reverser control cam 42 positioned across from pawl 170, while roller 174*a* falls out of a notch (not shown) which is located on a braking cam 74 positioned directly across from the pawl 174. This allows the drive control handle 12 to be moved out of its idle position.

The second pawl 172 includes two rollers 172*a* and 172*b* located at its opposite ends. When the drive control handle 12 is located in its idle position, roller 172*a* will fall into a notch (not shown) located in a propulsion control cam 54 positioned directly across from pawl 172, while roller 172*b* will fall out of a notch (not shown) located on the reverser control cam 42 positioned across from pawl 172. This allows the reverser control handle 14 to be moved out of its neutral position only when the drive control handle 12 is in its idle position.

In operation of the controller 10, when the reverser control handle 14 is in either its forward or reverse position, an operator may move the drive control handle 12 clockwise or counterclockwise, as viewed in FIG. 1, to apply braking power or propulsion power to the locomotive. When the drive control handle 12 is moved counterclockwise from its idle position, the drive gear 102 is caused to move counterclockwise, as shown in FIG. 8, resulting in movement of the freewheeling gear 122. As the freewheeling gear 122 rotates, an end portion of its slot 126 moves pin 130, causing rotation of the transition gear 128 and shaft 52. Rotation of the transition gear 128 results in its second outer portion 128*c* engaging with gear teeth 102*a* located on the drive gear 102. As the shaft 52 rotates, propulsion control cams 54 located thereon are rotated causing appropriate switches 62 to be actuated. This results in a desired amount of propulsion power being delivered to the locomotive.

As the drive control handle 12 is moved counterclockwise from its idle position, the drive gear 102 causes the freewheeling gear 142 to rotated therewith. Its slot, however, does not engage with pin 150 located on the transition gear 148. Consequently, transition gear 148 and shaft 72 remain stationary during rotation of the shaft 52.

If an operator wishes to apply braking power after initially applying propulsion power, the operator need only to rotate the drive control handle 12 clockwise, as viewed in FIG. 1. This will cause the drive gear 102 to rotate clockwise, as viewed in FIG. 4, resulting in the freewheeling gear 122 and the transition gear 128 rotating therewith. The transition gear 128, however, will only be rotated until its second portion 128*c* no longer engages with the drive gear 102. This occurs as the drive control handle 12 moves from its first drive position to its idle position. As noted above, just as the drive gear 102 disengages with the transition gear 128, roller 162*a* of pawl 160*a* acts, as it is being seated in recess 55*a*, to push against propulsion control cam 54*a* to rotate shaft 52 a few degrees to ensure that the transition gear 128 completely disengages with the drive gear 102.

As the drive control handle 12 is moved clockwise from its idle position to its set up position, the slot 146 on the freewheeling gear 142 will move pin 150 causing the transition gear 148 to begin to rotate. As the transition gear 148 rotates, its second outer portion 148*c* engages with the drive gear 102. Rotation of the transition gear 148 also causes corresponding rotation of its associated shaft 72 and brake control cams 74 located on the shaft 72. As the handle 12 moves from its set up position to its brake control zone, the shaft 72 and its brake control cams 74 thereon will continue to rotate causing actuation of appropriate switches 82 and the potentiometer. This results in a desired amount of braking power being delivered to the locomotive.

If an operator wishes to return the drive handle 12 to its idle position after applying braking power, the operator need only to move the drive handle 12 counterclockwise, as viewed in FIG. 1. This will cause the drive gear 102 to rotate counterclockwise, as view in FIG. 4, resulting in rotation of the freewheeling gear 142 and the transition gear 148. The transition gear 148 will only be rotated until its second portion 148*c* no longer engages with the drive gear 102. This occurs as the drive control handle 12 moves from its set-up position to its idle position. As noted above, just as the drive gear 102 disengages with the transition gear 148, roller 162*b* of pawl 160*b* acts, as it is being seated in recess 75*a*, to push against brake control cam 74*a* to rotate shaft 72 a few degrees to ensure that the transition gear 148 completely disengages with the drive gear 102.

When the drive control handle 12 is in its idle position, an operator may move the reverser control handle 14 in order to change the direction in which the locomotive travels. Upon movement of the reverser control handle 14, reverser cams 42 will rotate about shaft 72 so as to actuate appropriate direction control switches (not shown). This will result in the locomotive being driven in the desired travel direction.

Having described the controller of the present invention and its operation in detail and by reference to a preferred embodiment thereof, it will be apparent that modifications and variations are possible without departing from the scope of the invention.

What is claimed is:

1. A propulsion and brake control device for a vehicle comprising:

first shaft controller means, rotatable about a first axis, for controlling propulsion power for the vehicle;

second shaft controller means, rotatable about a second axis, for controlling braking power for the vehicle; and actuating means for selectively and alternatively rotating one of the first and second shaft controller means, the actuating means comprising:

drive means, movable in a first direction, for initiating rotational motion of the first shaft controller means and movable in a second direction for initiating rotational motion of the second shaft controller means;

first lost motion means mounted onto the first shaft controller means and being operatively engaged with the drive means, for transmitting initiating rotational motion from the drive means to the first shaft means upon the drive means being moved in the first direction, the first lost motion means comprising:

a first freewheeling gear rotatably mounted on the first shaft controller means and being engaged with the drive means to rotate therewith, the first freewheeling gear including a first accurate engagement slot therein; and a first transition gear fixed on the first shaft controller means and having a first outer portion which is non-engageable with the drive means and a second outer portion which is engageable with the drive means, the first transition gear further including a first engagement pin which extends into the slot and is movable by the slot when the drive means rotates in the first direction, wherein the first transition gear is rotated by the movement of the pin by the slot so as to permit the second outer portion of the first transition gear to engage the drive gear; and second lost motion means mounted onto the second shaft controller means, operatively engaged with the drive means, for transmitting initiating rotational motion from the drive means to the second shaft means upon the drive means being moved in the second direction, thereby controlling the propulsion power and the braking power for the vehicle.

2. The device of claim 1, wherein the drive means comprises a drive gear which is operatively connected to a single drive handle.

3. The device of claim 1, wherein the drive means comprises a drive gear which engages the first and second lost motion means.

4. The device of claim 3, wherein the drive gear is operatively connected to a drive handle.

5. The device of claim 1, wherein the second lost motion means comprises:

a second freewheeling gear rotatably mounted on the second shaft controller means and being engaged with the drive means to rotate therewith, the second freewheeling gear including a second accurate engagement slot therein; and a second transition gear being fixed on the second shaft controller means and having a first outer portion which is non-engageable with the drive means and a second outer portion which is engageable with the drive means, the second transition gear further including a second engagement pin which extends into the second slot and is movable by the second slot when the drive means rotates in the second direction, wherein the second transition gear is rotated by the movement of the second pin by the second slot so as to permit the second outer portion of the second transition gear to engage the drive gear.

6. The device of claim 5, wherein the first shaft controller means includes a first shaft having a square portion and a cylindrical portion, the first freewheeling gear being mounted for free rotation on the cylindrical portion and the first transition gear being fixedly mounted on the square portion.

7. The device of claim 6, wherein the second shaft controller means includes a second shaft having a square portion and a cylindrical portion, the second freewheeling gear being mounted for free rotation on the cylindrical portion of the second shaft and the second transition gear being fixedly mounted on the square portion of the second shaft.

8. A propulsion and brake control device for a locomotive comprising:

first shaft controller means being rotatable about a first axis for controlling propulsion power for the locomotive;

second shaft controller means being rotatable about a second axis for controlling braking power for the locomotive; and actuating means including a single drive handle for selectively and alternatively rotating one of the first and second shaft controller means, the actuating means comprising:

a drive gear, engageable with a first and a second lost motion means, movable in a first direction for initiating rotational motion of the first shaft controller means and being movable in a second direction for initiating rotational motion of the second shaft controller means;

first lost motion means mounted onto the first shaft controller means and being operatively engaged with the drive gear, the first lost motion means transmitting initiating rotational motion from the drive gear to the first shaft means upon the drive gear being moved in the first direction, wherein the first lost motion means comprises:

a first freewheeling gear rotatably mounted on the first shaft controller means and being engaged with the drive gear to rotate therewith, and the first freewheeling gear including a first engagement slot therein; and a first transition gear fixed on the first shaft controller means and having a first outer portion which is non-engageable with the drive gear and a second outer portion which is engageable with the drive gear, the first transition gear further including a first engagement pin which extends into the slot and is movable by the slot when the drive gear rotates in the first direction, wherein the first transition gear is rotated by the movement of the pin by the slot so as to permit the second outer portion of the first transition gear to engage the drive gear; and second lost motion means mounted onto the second shaft controller means and being operatively engaged with the drive gear, the second lost motion means transmitting initiating rotational motion from the drive gear to the second shaft means upon the drive gear being moved in the second direction thereby controlling the propulsion power and the braking power for the locomotive.

9. The device of claim 8, wherein the second lost motion means comprises:

a second freewheeling gear rotatably mounted on the second shaft controller means and being engaged with the drive gear to rotate therewith, and the second freewheeling gear including a second accurate engagement slot therein; and a second transition gear being fixed on the second shaft controller means and having a first outer portion which is non-engageable with the drive means and a second outer portion which is engageable with the drive gear, the second transition gear further including a second engagement pin which extends into the second slot and is movable by the second slot when the drive gear rotates in the second direction, wherein the second transition gear is rotated by the movement of the second pin by the second slot so as to permit the second outer portion of the second transition gear to engage the drive means.

10. The device of claim 9, wherein the second shaft controller means includes a second shaft having a square portion and a cylindrical portion, the second freewheeling gear being mounted on the cylindrical portion of the second shaft and the second transition gear being mounted n the square portion of the second shaft.

11. The device of claim 8, wherein the first shaft controller means includes a first shaft having a square portion and a cylindrical portion, the first freewheeling gear being mounted on the cylindrical portion and the first transition gear being mounted on the square portion.

* * * * *